US008960648B2

(12) United States Patent
Martin

(10) Patent No.: US 8,960,648 B2
(45) Date of Patent: Feb. 24, 2015

(54) WET DUST SUPPRESSION FLOOR CLEANING SYSTEM

(71) Applicant: Minuteman International, Inc., Hampshire, IL (US)

(72) Inventor: Ethan Martin, Aberdeen, NC (US)

(73) Assignee: Minuteman International, Inc., Hampshire, IL (US)

( * ) Notice: Subject to any disclaimer, the term of this patent is extended or adjusted under 35 U.S.C. 154(b) by 222 days.

(21) Appl. No.: 13/712,277

(22) Filed: Dec. 12, 2012

(65) Prior Publication Data

US 2014/0159257 A1 Jun. 12, 2014

(51) Int. Cl.

| | |
|---|---|
| ***B01F 3/04*** | (2006.01) |
| ***A47L 11/40*** | (2006.01) |
| ***E01H 1/08*** | (2006.01) |
| ***B08B 5/02*** | (2006.01) |
| ***B08B 17/00*** | (2006.01) |

(52) U.S. Cl.

CPC ..... *A47L 11/4097* (2013.01); *E01H 1/0872* (2013.01); *B08B 5/02* (2013.01); *B08B 17/00* (2013.01)

USPC ..... 261/30; 261/34.1; 261/38; 261/64.1; 261/72.1; 261/78.2; 261/116; 15/345; 15/346

(58) Field of Classification Search

CPC .... B01F 3/04; B01F 3/04007; B01F 3/04021; B01F 3/04049; B01F 3/04063; A47L 5/14

USPC ..... 261/30, 34.1, 38, 64.1, 72.1, 78.2, 116; 15/340.1, 340.3, 345, 346, 340.4

See application file for complete search history.

(56) References Cited

U.S. PATENT DOCUMENTS

| | | | | |
|---|---|---|---|---|
| 3,977,039 | A | | 8/1976 | Block |
| 4,938,239 | A | * | 7/1990 | Theurer et al. ..... 134/21 |

FOREIGN PATENT DOCUMENTS

| | | | |
|---|---|---|---|
| DE | 23 59 200 | | 6/1975 |
| DE | 10 2005 020 018 | A1 | 11/2006 |
| JP | 2000120596 | A * | 4/2000 |
| WO | WO 2007/019604 | | 2/2007 |

* cited by examiner

*Primary Examiner* — Robert A Hopkins

(74) *Attorney, Agent, or Firm* — Greer, Burns & Crain, Ltd.

(57) ABSTRACT

An arrangement for removing dust from the atmosphere during cleaning of a generally flat surface, such as floor, includes a reservoir for providing water to a nozzle. Also included is an air compressor and a compressed air tank. Compressed air is provided in a controlled manner at an elevated pressure to the nozzle to reduce the water to minute droplets which absorb/encapsulate the dust particles and deposit them on the floor surface under the influence of gravity. A manual or automatic pressure regulator coupled to the outlet of the compressed air tank allows for selecting the air velocity and the size of the water droplets to match the size of the dust particles to increase the extent of dust removal. This dust removal approach can be used with virtually any type of generally flat surface and the compressed air has a siphoning effect to increase the water droplets produced and the dust particles removed.

16 Claims, 6 Drawing Sheets

WET DUST SUPPRESSION FLOOR CLEANING SYSTEM

FIELD OF THE INVENTION

This invention relates generally to the removal of dust particles from the atmosphere, and is particularly directed to a dust suppression system for use with a mobile cleaning device such as a floor sweeper/scrubber.

BACKGROUND OF THE INVENTION

High pressure water systems are commonly used in mobile cleaning machines for cleaning indoor surfaces such as floors and outdoor surfaces such as streets and parking lots. The high pressure water is applied to the surface to loosen and remove dirt and grit from the surface being cleaned. The dispensed water also serves to trap and maintain lightweight particles such as dust on the surface being cleaned to facilitate its removal by the cleaning machine. The water is discharged through minute orifices located in a nozzle to vaporize the water and form a water mist. The small orifices are easily clogged by minute particles of dirt and virtually any other type of foreign matter within the water reservoir which reduces the reliability and effectiveness of this is approach. In addition, the presence of various other contaminants in the water, such as algae, can also easily clog nozzle apertures preventing the discharge of the water. This approach also uses large quantities of water to cover the entire surface being cleaned, requiring frequent water replenishment, and affords only limited water dispersal over the surface being cleaned.

The present invention addresses the aforementioned limitations of the prior art by providing a wet dust suppression floor cleaning system which produces large quantities of very small water droplets which are adapted for contact with and attachment to atmospheric dust for directing the dust particles onto the surface being cleaned, where the dust particles remain until swept or vacuumed up.

OBJECTS AND SUMMARY OF THE INVENTION

Accordingly, it is an object of the present invention to remove dust from the atmosphere during cleaning of a generally planer surface such as a floor or a paved or concrete outside surface.

It is another object of the present invention to quickly and efficiently remove dust particles from the atmosphere by producing small water droplets directed into the atmosphere which absorb or adhere to the dust particles and direct under the influence of gravity the dust particles to a generally flat surface being cleaned.

It is a further object of the present invention to provide a spray system for use in a mobile cleaning machine for the removal of dust particles from the atmosphere during cleaning using a fine mist of water particles sized so as to match the dust particle size for highly efficient dust removal.

A still further object of the present invention is to reduce the amount of water required in the cleaning of a generally planer surface and the amount of dust produced in the atmosphere during cleaning of the surface.

The present invention contemplates apparatus for removing dust particles from the atmosphere during cleaning of a generally flat surface, the apparatus comprising: a compressed air source; a water reservoir; a controller coupled to the compressed air source for controlling compressed air flow from the compressed air source; and a nozzle coupled to the compressed air source and to the water reservoir for receiving compressed air and water, wherein the compressed air reduces the water to a fine mist of droplets, and wherein the water droplets engage and become attached to the dust particles and remove the dust particles from the atmosphere by depositing the dust particles on the generally flat surface under the influence of gravity.

BRIEF SUMMARY OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
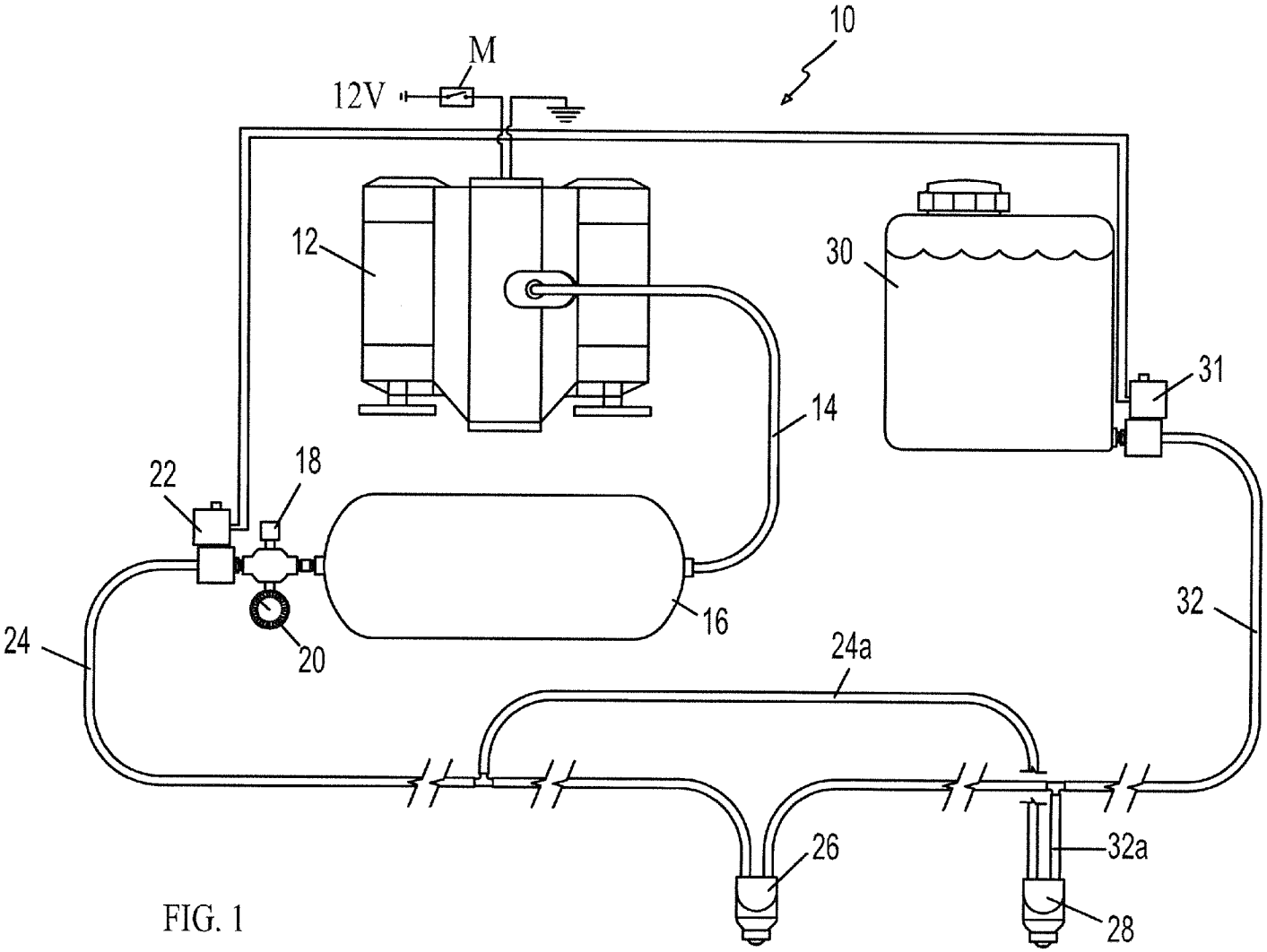
FIG. 1 is a simplified schematic diagram of a wet dust suppression floor cleaning system in accordance with the principles of the present invention.
Figure 2:
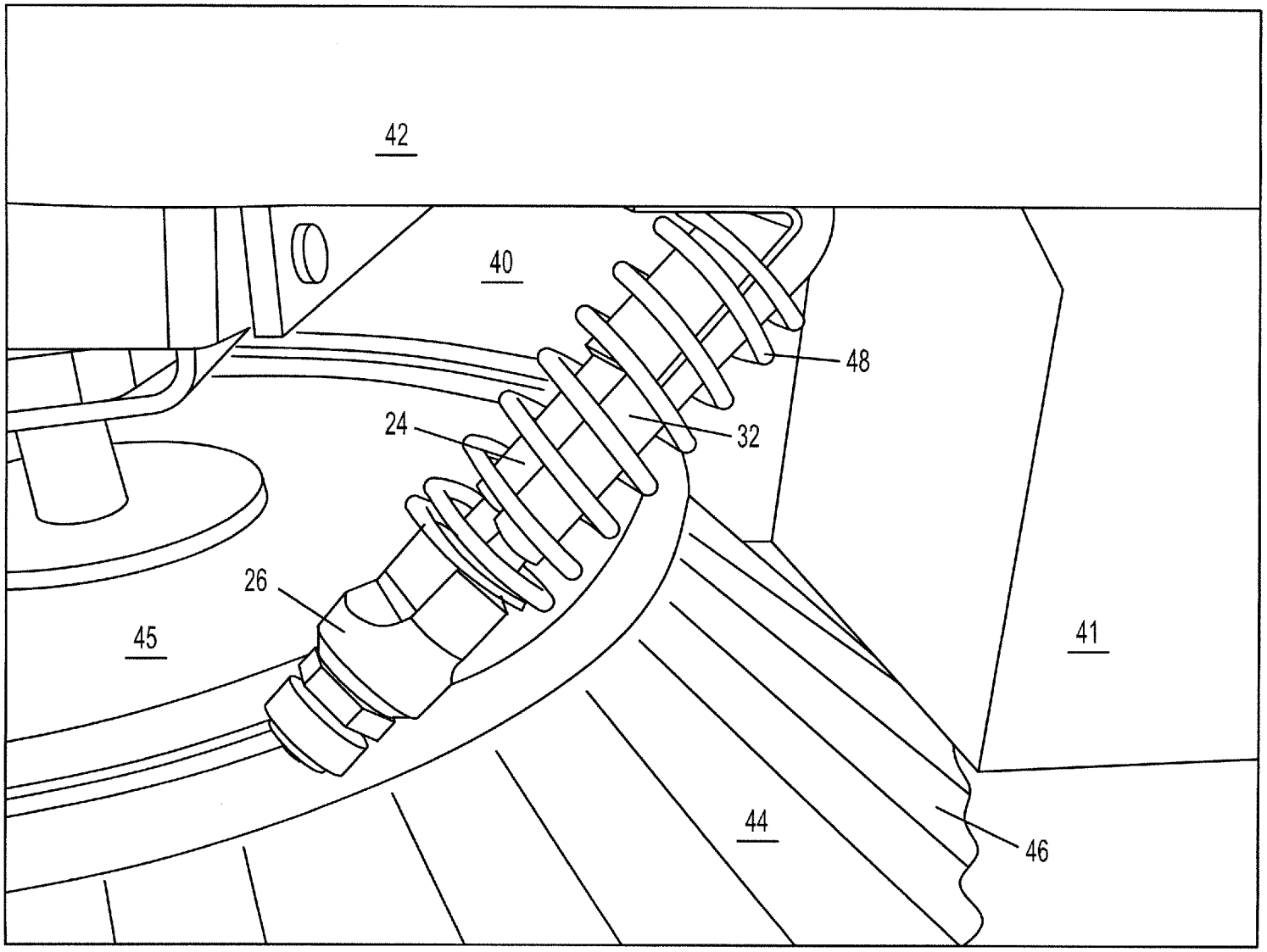
FIG. 2 illustrates a nozzle disposed on a floor cleaning machine for discharging a fine mist of water droplets adjacent a rotary brush in accordance with the present invention.
Figure 3:
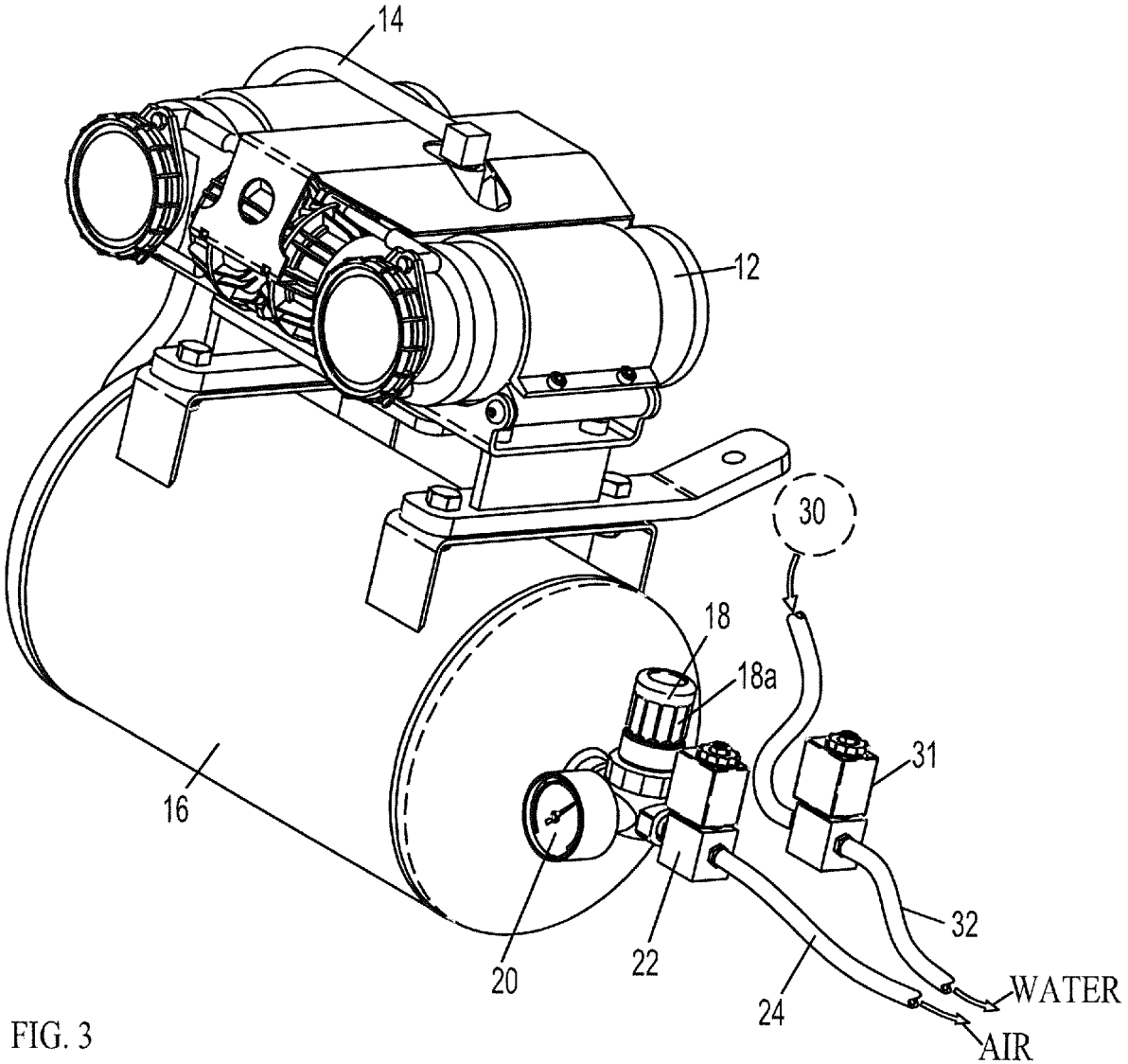
FIG. 3 is a perspective view of a preferred embodiment of the inventive wet dust suppression floor cleaning system of the present invention.
Figure 4A:
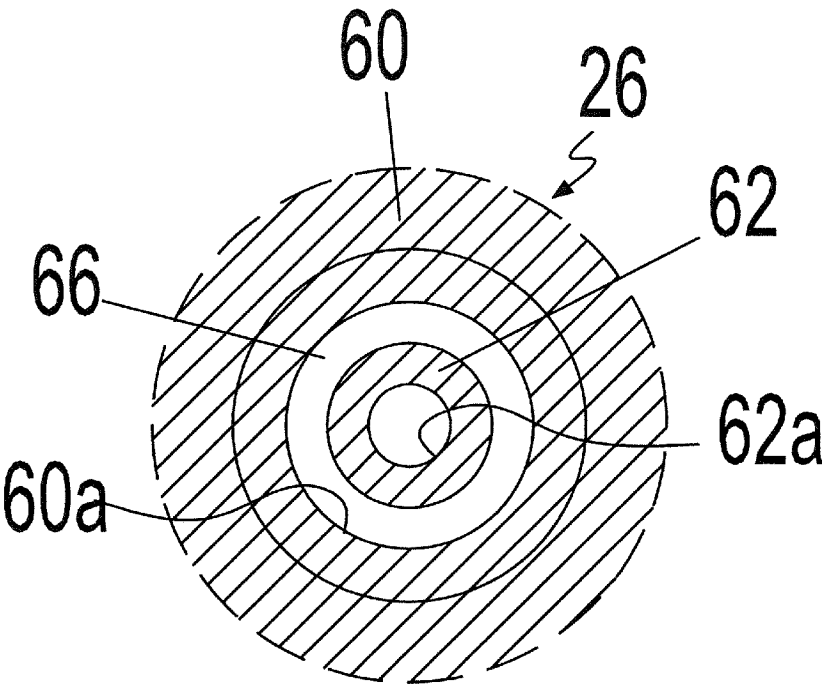
FIGS. 4*a*, 4*b* and 4*c* are respectively transverse, detailed longitudinal, and extended longitudinal sectional views of a nozzle used in the inventive wet dust suppression floor cleaning system for vaporizing the water flow in the form of small water droplets.
Figure 4B:
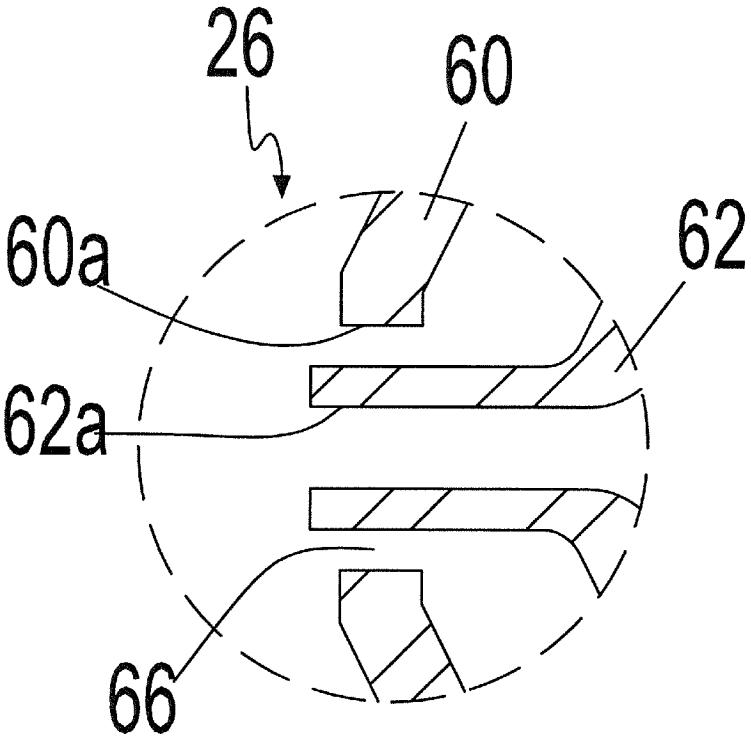
Figure 4C:
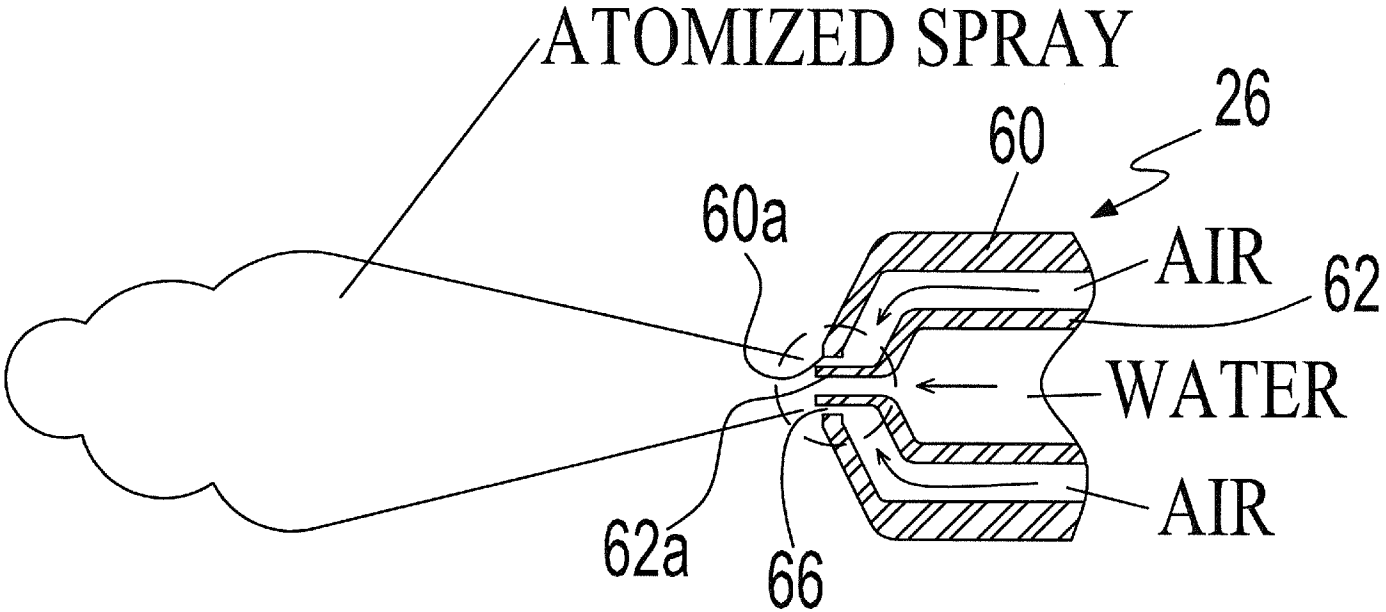

Referring to FIG. 1, there is shown a simplified schematic diagram of a wet dust suppression floor cleaning system 10 in accordance with the present invention. FIG. 2 illustrates a portion of the dust suppression system 10 including a nozzle 26 disposed on a floor cleaning machine 40 for discharging a fine mist of water droplets adjacent a rotary brush 44 disposed on the cleaning machine. FIG. 3 is a perspective view of a preferred embodiment of the inventive wet dust suppression floor cleaning system 10 of the present invention. FIGS. 4*a*, 4*b* and 4*c* are respectively transverse, detailed longitudinal, and extended longitudinal sectional views of a nozzle 26 used in the inventive wet dust suppression floor cleaning system of the present invention.

The dust suppression system 10 includes an air compressor 12 connected to a compressed air tank 16 by means of a high temperature air line, or hose, 14. High temperature line 14 is capable of carrying compressed air at a temperature as high as 300° F. from air compressor 12 to compressed air tank 16. Compressed air tank 16 has a capacity on the order of two gallons, although virtually any size compressed air tank could be used in the present invention. Compressed air tank 16 serves as a temporary storage chamber for the compressed air and allows air compressor 12 to operate in an intermittent manner by temporarily storing the compressed air. A continuous flow of air under pressure is provided at the output of the compressed air tank 16 by means of the combination of a pressure regulator 18 and a first electric solenoid valve 22. The first solenoid valve 22 provides a continuous pressure of the compressed air on the order of 15-25 PSI in a preferred embodiment. Pressure regulator 18 is of the rotary type having an outer manual knob-like control 18*a* for providing continuous air pressure control over a range of 15-25 PSI. The present invention also contemplates automatic control of the pressure of the compressed air. The first electric solenoid valve 22 serves as an ON and OFF switch in controlling discharge of the compressed air from the compressed air tank 16. Also provided at the output of compressed air tank 16 is a visual pressure gauge 20 which provides a visual indication to an operator of the pressure of the compressed air released from the compressed air tank.

The compressed air released from the compressed air tank 16 is provided via a flexible line 24 to a first nozzle 26. The first flexible line 24 is preferably in the form of a nylon tube, or hose, having a pressure rating in the range of 90-120 PSI, although the compressed air is maintained within the aforementioned range of 15-25 PSI by pressure regulator 18. The pressurized air from compressed air tank 16 may also be provided from the first flexible line 24 via a second flexible line, or branch hose, 24*a* to a second nozzle 28 as shown in the figure.

Dust suppression system 10 further includes a water reservoir 30 having a capacity on the order of 5-7 gallons. Water reservoir 30 is coupled by means of a first water line 32 to the first nozzle 26, and may also be coupled to the second nozzle 28 by means of a second water line 32*a* coupled to the first water line. Disposed at the outlet of the water reservoir 30 to the first water line 32 is a second electric solenoid valve 31 for controlling the ON and OFF functions of the water reservoir. The first and second electric solenoid valves 22, 31 are preferably coupled to a common control arrangement including a manually operated control switch M for simultaneously controlling and operating both solenoid valves either in the ON state or the OFF state.

Referring to FIG. 2, there is shown the preferred position of the first nozzle 26 in a conventional scrubber/cleaning machine 40. The scrubber/cleaning machine 40 is shown as including a front bumper 42 and a debris hopper 41. Attached to a lower portion of the scrubber/cleaning machine 40 is a rotary brush 44 having an inner hub 45. Hub 45 is connected to a rotary drive arrangement, which is not shown in the figure for simplicity, in a conventional manner. Attached to a lower, peripheral portion of hub 45 are plural spaced peripheral bristles 46. In a typical scrubber/cleaning machine 40, rotary brush 44 is disposed on a forward portion of the machine, with the right forward rotary brush shown in FIG. 2. Rotary brush 44 is rotationally displaced in a counterclockwise direction as viewed in FIG. 2 so as to sweep debris and dirt inwardly toward the center-line of scrubber/cleaning machine 40, or rightward as viewed in FIG. 2. Nozzle 26 is attached to the first flexible hose 24 and to first water line 32 for respectively receiving pressurized air and water. The combination of the first nozzle 26 and the respective ends of the first flexible hose 24 and the first water line 32 are attached to a forward portion of the scrubber/cleaning machine 40 by means of a flexible coiled spring 48 which allows for displacement of the first nozzle upon impact with an object disposed on, or adjacent to, the floor being cleaned. First nozzle 26 is disposed adjacent to a leading, inner portion of rotary brush 44. First nozzle 26 directs water vapor in the form of small droplets into the space above the leading, inner portion of rotary brush 44 and into the dust formed by the rotary motion of the brush. The small water droplets engage the dust particles and adhere to these dust particles. The combined water and dust particles fall on the surface of the floor being cleaned under the influence of gravity and are directed inwardly, together with the dirt and grit agitated by the rotary brush, toward the centerline of the scrubber/cleaning machine 40 to be swept and/or vacuumed up. First nozzle 26 is preferably oriented downwardly at an inclined angle to direct the water droplets in a downward direct toward the surface being cleaned.

Referring to FIG. 4*c*, there is shown a longitudinal sectional view of the first nozzle 26 taken along the water and air flow lines through the nozzle. A transverse view and a detailed longitudal sectional view of the end portion of the first nozzle 26 are respectively shown in FIGS. 4*a* and 4*b*. The second nozzle 28 is of similar configuration and operation. Nozzle 26 includes a first outer housing 60 having a generally circular aperture 60*a* in a forward portion thereof. Nozzle 26 further includes a second, inner housing 62 concentrically disposed within the outer housing 60 and having a circular forward discharge aperture 62*a* therein. Aperture 66 is annular in shape and is concentrically disposed about the forward portion of the first outer housing 62 and aperture 62*a* therein. Air under pressure is introduced between outer housing 60 and inner housing 62 and is discharged from the nozzle 26 via annular aperture 66 disposed between respective forward portions of the outer and inner housings.

The air discharged under pressure from annular aperture 66 is disposed about the water discharged from the aperture 62*a* of nozzle's inner housing 62 and reduces the pressure about the discharged water producing vaporization of the water into small droplets. These water droplets engage and become attached to the dust particles in the atmosphere above the surface being cleaned. These dust-bearing water droplets under the influence of gravity move downward toward and onto the surface being cleaned. As a result, the dust/water droplets are removed from the atmosphere and deposited on the surface being cleaned. The small size of the water droplets result in most of the water evaporating upon contact with the surface being cleaned, leaving only the dust particles on this surface. The dust particles are then easily removed from the flat surface by a sweeping action with the assistance of an applied vacuum. In addition, increasing the air flow incident on the water discharged from the nozzle in windy conditions will result in increased deposition of the dust particles on the surface being cleaned by reducing the tendency of the wind to increase drifting of the dust particles. Finally, increasing the air flow incident on the water discharged from the nozzle also has a siphoning effect on the water discharged from the water reservoir. This siphoning effect increases the amount of water vapor discharged into the atmosphere producing a corresponding increase in the amount of dust removed from the atmosphere.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. Apparatus for removing dust particles from the atmosphere during cleaning of a generally flat surface, said apparatus comprising:

a compressed air source;

a water reservoir;

a first controller coupled to said compressed air source for controlling compressed air flow; and a first nozzle coupled to said compressed air source and to said water reservoir for receiving said compressed air flow and a water flow, wherein said compressed air flow reduces said water flow to a fine mist of water droplets, and wherein said water droplets engage and become attached to the dust particles and remove the dust particles from the atmosphere above the first portion of the generally flat surface by depositing the dust particles on the generally flat surface under the influence of gravity, wherein said first nozzle includes a first inner housing coupled to said water reservoir and having a first aperture therein through which the water is directed, said first nozzle further including a second outer housing disposed about said first inner housing and coupled to said compressed air source, said second outer housing further including a second aperture concentrically disposed about said first aperture for directing compressed air about and upon the water discharged from said first aperture wherein said second outer housing forms a third annular aperture concentrically disposed about said first aperture in said first housing, and wherein the compressed air is discharged from said first nozzle through said annular aperture.

2. The apparatus of claim 1, wherein said compressed air source includes an air compressor and a compressed air tank coupled to said air compressor for storing compressed air, wherein said compressed air tank is further coupled to said nozzle via said first controller.

3. The apparatus of claim 1 further comprising an air line coupling said air compressor to said compressed air tank.

4. The apparatus of claim 2, wherein said first controller includes a pressure regulator coupled to an output port of said compressed air tank.

5. The apparatus of claim 4, wherein said pressure regulator is manually or automatically controlled.

6. The apparatus of claim 4, wherein said pressure regulator further includes a first solenoid valve for turning the compressed air flow from said compressed air tank ON and OFF.

7. The apparatus of claim 1 further comprising a second controller coupled to said water reservoir for controlling the flow of water from said water reservoir.

8. The apparatus of claim 7, wherein said second controller includes a second solenoid valve to turn the water flow from said water reservoir ON and OFF.

9. The apparatus of claim 1, wherein said first controller allows for increasing or decreasing the compressed air flow depending upon operating conditions.

10. The apparatus of claim 9, wherein said operating conditions include atmospheric conditions and dust particle size.

11. The apparatus of claim 10, wherein said first controller allows for increasing the compressed air flow to produce a higher volume of smaller water particles adapted to engage and remove smaller dust particles, or for deceasing the compressed air flow to produce a lower volume of larger water particles adapted to engage and remove larger dust particles from the atmosphere.

12. The apparatus of claim 10, wherein said first controller allows for increasing the compressed air flow in windy conditions to direct the water particles combined with the dust particles downward toward the generally flat surface.

13. The apparatus of claim 1, wherein said first nozzle is disposed on a mobile cleaning machine.

14. The apparatus of claim 1, further comprising a second nozzle coupled to said compressed air source and to said water reservoir for receiving said compressed air flow and a water flow for removing dust particles from the atmosphere above a second portion of the generally flat surface, wherein said first and second portions of the generally flat surface are in spaced relation to one another.

15. The apparatus of claim 14, wherein said first and second nozzles are disposed on a mobile cleaning machine.

16. Apparatus for removing dust particles from the atmosphere, said apparatus comprising:

a first inner housing coupled to a source of water and having a first aperture therein, wherein water is discharged from said first inner housing via said first aperture; and a second outer housing coupled to a source of compressed air and having a second generally circular aperture therein, wherein said second aperture is concentrically disposed about said first aperture so as to form a third annular aperture disposed about said first aperture and between said first and second housings;

wherein compressed air discharged from said third annular aperture about said first aperture vaporizes water discharged from said first aperture into small water droplets adapted to engage and adhere to atmospheric dust particles, and wherein the dust-bearing water droplets fall under the influence of gravity to a surface disposed below the first and second housings.

* * * * *